US011497946B2

(12) United States Patent
Tseng

(10) Patent No.: US 11,497,946 B2
(45) Date of Patent: Nov. 15, 2022

(54) RESPIRATORY PROTECTION MASK

(71) Applicant: MAKRITE INDUSTRIES INC., New Taipei (TW)

(72) Inventor: Chao-yuan Tseng, New Taipei (TW)

(73) Assignee: MAKRITE INDUSTRIES INC., New Taipei (TW)

( * ) Notice: Subject to any disclaimer, the term of this patent is extended or adjusted under 35 U.S.C. 154(b) by 373 days.

(21) Appl. No.: 15/930,455

(22) Filed: May 13, 2020

(65) Prior Publication Data

US 2021/0353975 A1 Nov. 18, 2021

(51) Int. Cl.

| | |
|---|---|
| ***A62B 18/02*** | (2006.01) |
| ***A62B 9/04*** | (2006.01) |
| ***A62B 19/00*** | (2006.01) |
| ***A62B 23/00*** | (2006.01) |
| ***A62B 23/02*** | (2006.01) |

(52) U.S. Cl.

CPC ..... *A62B 18/025* (2013.01); *A62B 9/04* (2013.01); *A62B 19/00* (2013.01); *A62B 23/00* (2013.01); *A62B 23/025* (2013.01); *A62B 23/02* (2013.01)

(58) Field of Classification Search

CPC .... A62B 7/00; A62B 7/10; A62B 9/00; A62B 9/02; A62B 9/04; A62B 18/02–025; A62B 18/08; A62B 18/084; A62B 18/088–10; A62B 19/00; A62B 23/00–02; A61M 16/06–0655; A61M 2016/0661

See application file for complete search history.

(56) References Cited

U.S. PATENT DOCUMENTS

| | | | | |
|---|---|---|---|---|
| 8,839,788 | B2 * | 9/2014 | Betz | A62B 9/04 128/206.19 |
| 2003/0047183 | A1 * | 3/2003 | Kiefer | A62B 18/082 128/201.15 |
| 2009/0217926 | A1 * | 9/2009 | Hine | A62B 18/02 128/201.25 |
| 2017/0021203 | A1 * | 1/2017 | Baker | A62B 19/00 |
| 2018/0289988 | A1 * | 10/2018 | Gerson | A41D 13/1161 |

* cited by examiner

*Primary Examiner* — Rachel T Sippel

(57) ABSTRACT

A respiratory protection mask includes detachably connected main body and front cover. The main body includes a shielding member for shielding a wearer's mouth and nose, and has air outlet with air-outlet valve and air inlets with air-inlet valves. The mask is characterized in a guide structure and a limiting structure provided between the main body and the front cover. The guide structure includes corresponding slide rail and slide channel capable of guiding the front cover to move along a linear path parallel to a longitudinal section of the air outlet to assemble to the main body and cover the air-outlet valve. The limiting structure includes corresponding male and female fasteners that are detachably engaged with each other when the front cover is assembled to the main body, preventing the front cover from moving in an opposite direction on the linear path to separate from the main body.

9 Claims, 9 Drawing Sheets

RESPIRATORY PROTECTION MASK

FIELD OF THE INVENTION

The present invention relates to a mask capable of screening out airborne hazardous pollutants, and more particularly, to a respiratory protection mask including a front cover detachably connected to a main body to cover an air-outlet valve on the main body.

BACKGROUND OF THE INVENTION

A mouth mask or a face mask is a device being worn by a wearer to screen out airborne hazardous pollutants. Among others, there is a type of mask with an additionally mounted filter, such as a particulate filter or a toxic gas filter. This type of mask includes an airtight main body for covering the wearer's mouth and nose and being provided with a one-way air-outlet valve, one or more one-way air-inlet valves, and one or more filters additionally mounted on the one-way air-inlet valves, so that external air is filtered by the filters before it is inhaled by the wearer.

To maintain the one-way valves in a clean state, the existing masks would include caps to cover the one-way valves. To enable convenient replacement of diaphragms in the one-way valves or to enable easy cleaning, repairing or replacement of the main body, the caps or other parts of the mask, some of the existing masks are provided with detachable caps. Currently, there are various detachable structural designs available to ensure secured connection between the parts of the mask and convenient assembling and disassembling of these parts.

SUMMARY OF THE INVENTION

A primary object of the present invention is to provide a respiratory protection mask, which includes a front cover that can be assembled to or disassembled from a main body through a linear one-way movement. With the simple manner, the main body and the front cover can be easily assembled or detached to enable cleaning or replacement thereof.

To achieve the above and other objects, the respiratory protection mask according to an embodiment of the present invention includes a main body and a front cover. The main body includes a shielding member for shielding a wearer's mouth and nose. The shielding member is formed with an air outlet having an air-outlet valve mounted thereto and more than one air inlet each having an air-inlet valve mounted thereto. The front cover is detachably assembled to the main body.

The above described respiratory protection mask is characterized in having, a guide structure and a limiting structure provided between the main body and the front cover. The guide structure includes a slide rail formed on the main body and a slide channel formed on the front cover. The slide channel is guided by the slide rail to thereby bring the front cover to move along a linear path that is parallel to a longitudinal section of the air outlet, such that the front cover is, assembled to the main body in an assembling direction of the linear path and covers the air-outlet valve. The limiting structure includes a male fastener formed on the front cover and a female fastener formed on the main body. The male fastener is able to engage with the female fastener when the front cover is located at an assembled position on the linear path, such that the front cover is stopped from moving away from the assembled position in a detaching direction opposite to the assembling direction and becoming detached from the main body.

In a preferred embodiment, the front cover includes a covering portion used to cover the air outlet when the front cover is located at the assembled position; and the covering portion is able to change a direction in which air exhaled via the air outlet flows, such that the exhaled air flows out of the mask via an opening of the front cover that downwardly faces toward the ground.

In the above-described preferred embodiment, the front cover further includes an extension portion extended from an end of the covering portion facing in the detaching direction; the male fastener is formed on the extension portion and is detachable from the female fastener when any one of the main body and the extension portion is flexibly deformed.

The main body includes a substantially vertical flat portion and a beveled portion located corresponding to the covering portion and the extension portion of the front cover, respectively, so that a space is formed between the beveled portion and the extension portion.

The female fastener is formed on the flat portion; and the male fastener, when moving in the assembling direction, is in contact with the beveled portion, the flat portion and the female fastener sequentially, such that the male fastener and the flat portion push against each other to cause deformation of one of the front cover and the main body.

In a preferred embodiment, the limiting structure further includes a male push section formed on the front cover and a female push section formed on the main body; and the male and the female push section are used to stop the front cover from moving further in the assembling direction after the front cover has been moved to the assembled position.

In the above-described preferred embodiment, the slide rail includes two parallelly spaced slide rail units. The female push section and the slide rail units together form a U-shaped stop wall that externally extends along an open end of the air-outlet valve.

In an embodiment, the main body further includes a supporting member detachably connectable to the shielding member. The air-outlet valve, the at least one air-inlet valve and the slide rail are formed on the supporting member; and the shielding member is sandwiched between the supporting member and the front cover after the front cover has been assembled to the main body.

The slide rail is provided toward an opening direction and near two lateral sides of the air outlet with two elongated ribs, and the slide channel is provided at locations corresponding, to the elongated ribs with two grooves; and the engagement of the elongated ribs with the grooves further enables the front cover and the supporting member to produce an increased sandwiching force to sandwich the shielding member between them.

Accordingly, with, the slide rail formed on the main body of the mask and the slide channel correspondingly formed on the front cover, the front cover can be linearly moved in one direction to be easily assembled to the main body. On the other hand, with the limiting structure having parts that can be flexibly deformed to become detached from each other, the front cover can be linearly moved in an opposite direction to be easily separated from the main body.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and by referring to the accompanying drawings.

Figure 1:
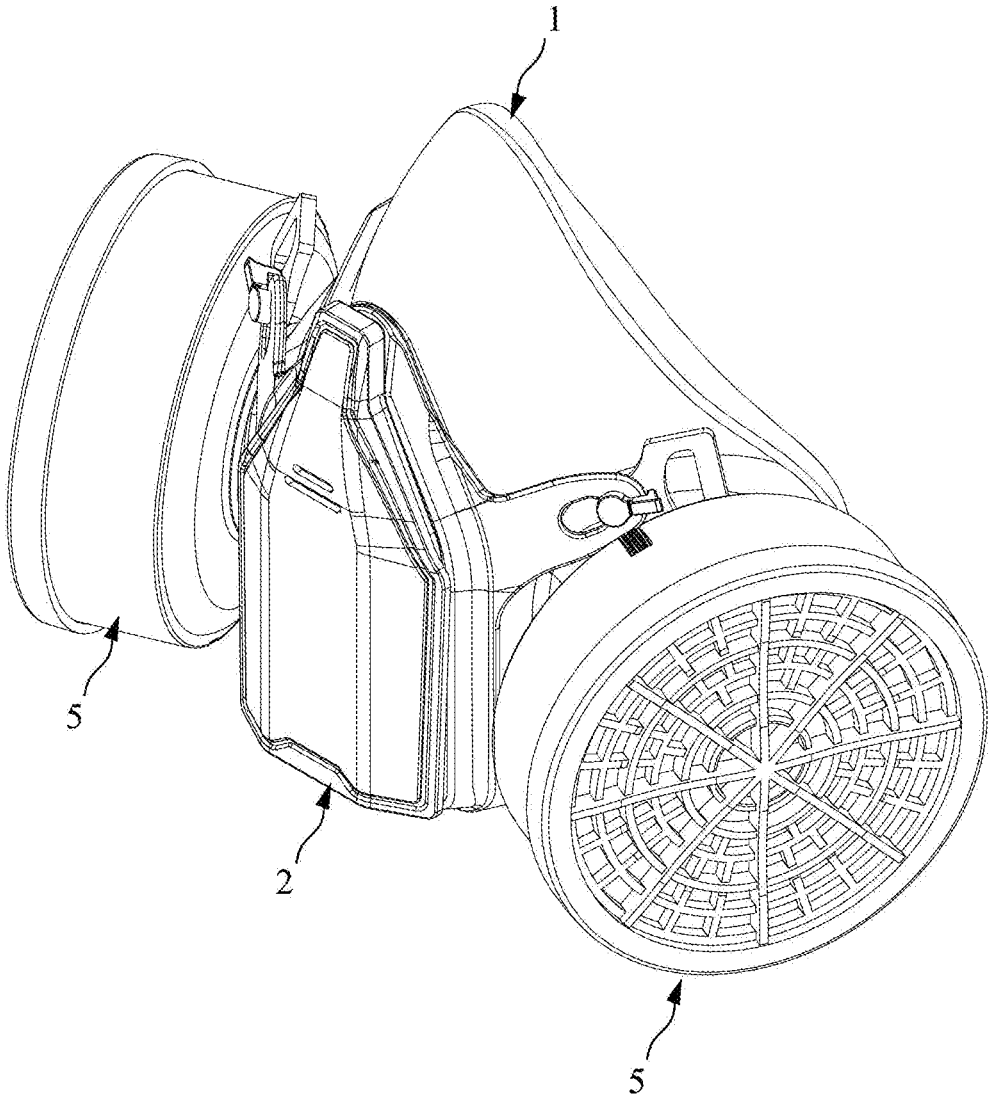
FIG. 1 is an assembled perspective view of a respiratory protection mask according to a preferred embodiment of the present invention.
Figure 2:
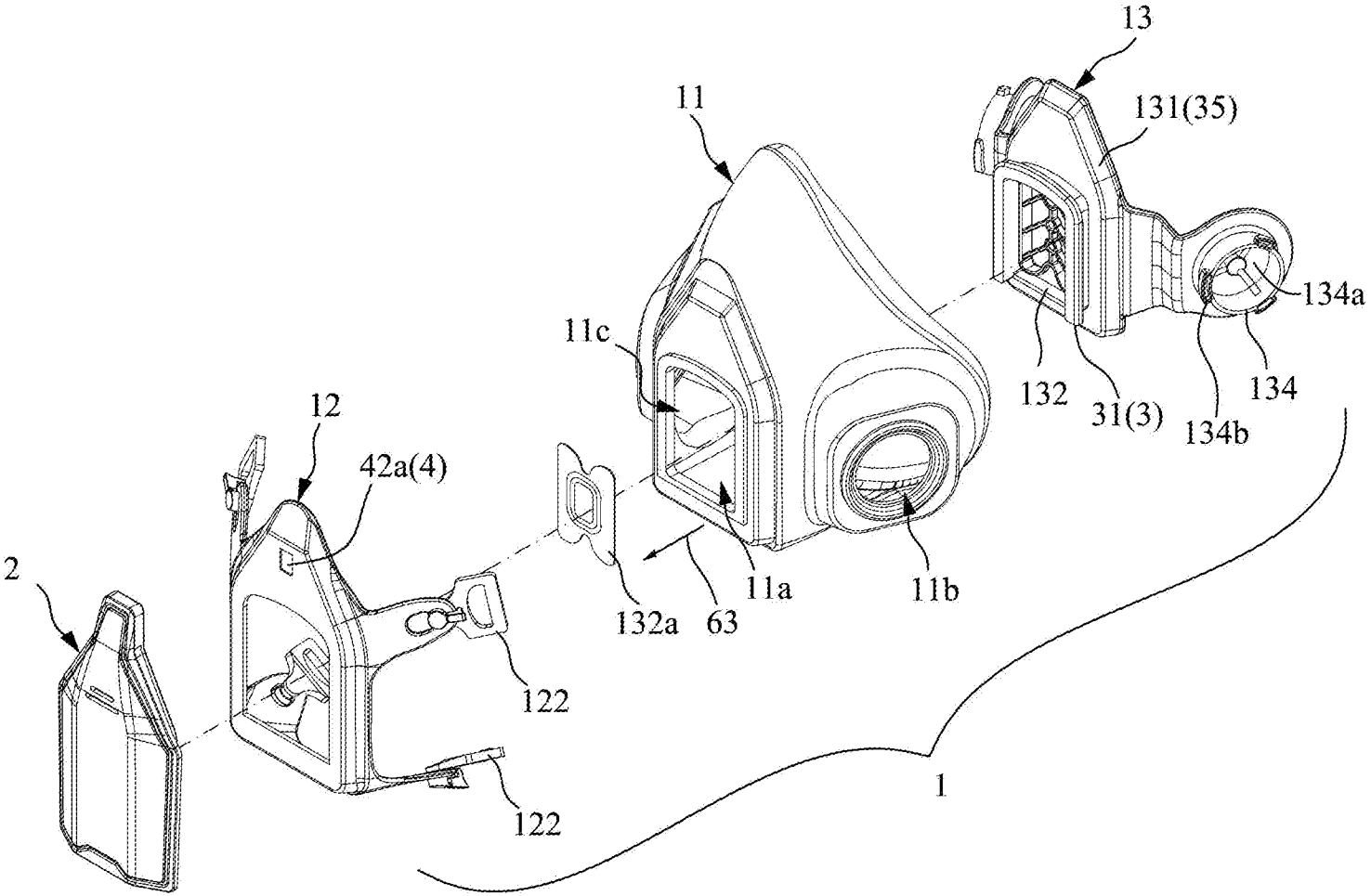
FIG. 2 is an exploded perspective view of the respiratory protection mask of FIG. 1 with two additionally mounted filters removed therefrom.

Please refer to FIGS. 1 and 2. A respiratory protection mask according to a preferred embodiment of the present invention includes a main body 1, a front cover 2, and more than one additionally mounted filter 5 mounted on the main body 1 for filtering air passing therethrough to enter into the mask. The main body 1 and the front cover 2 are detachably assembled together via a guide structure 3 and a limiting structure 4.

Figure 3:
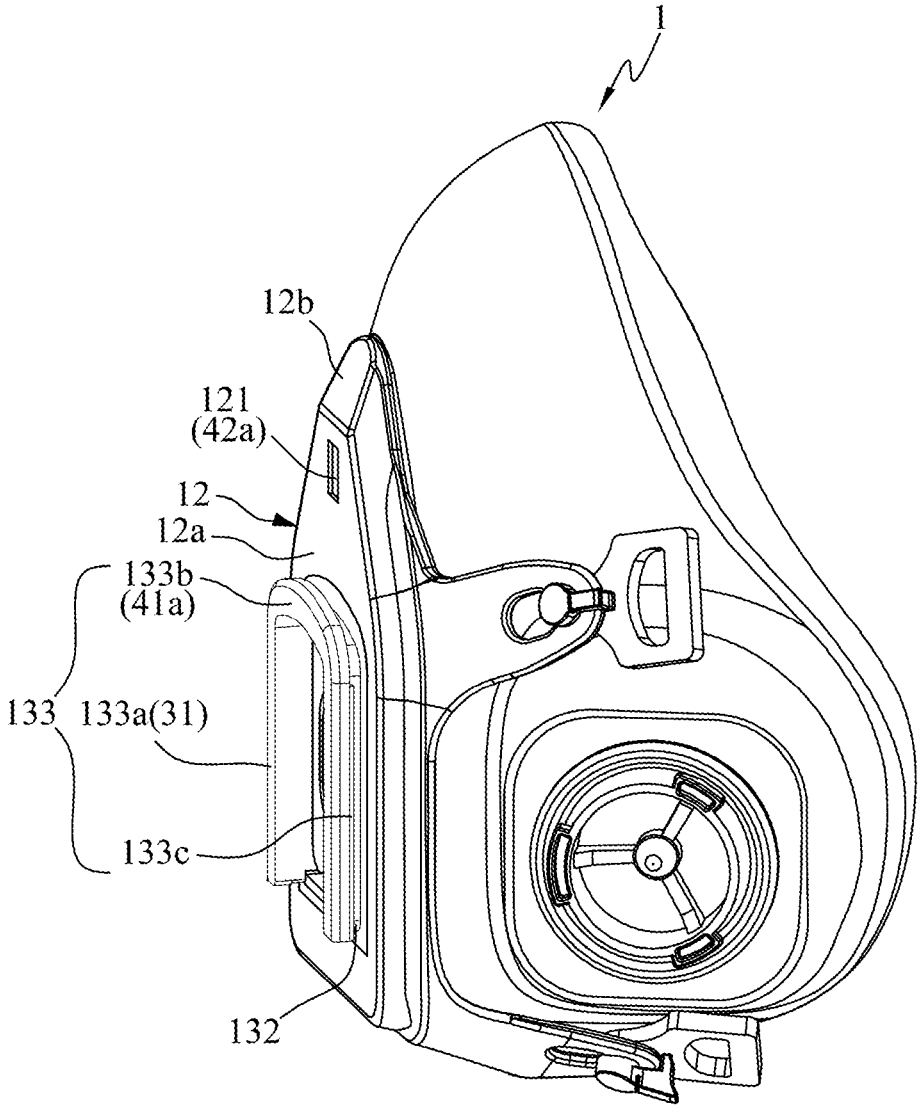
FIG. 3 is an assembled perspective view of a main body of the respiratory protection mask of FIG. 1.

Please refer to FIGS. 2 and 3. According to the preferred embodiment of the present invention, the main body 1 includes a shielding member 11 for shielding a wearer's mouth and nose, a locating member 12 for connecting to a plurality of tie bands (not shown), and a supporting member 13. The shielding member 11 is formed with a forward-faced air outlet 11*a* and two air inlets 11*b* located at two opposite lateral sides of the air outlet 11*a*. The locating member 12 is connected to the above-mentioned tie bands via a plurality of detachable buckles 122 provided on the locating member 12 at different locations. The supporting member 13 includes a support frame 131, which has a substantially U-shaped configuration corresponding to an inner side shape of the shielding member 11, and an air-outlet valve 132 and two air-inlet valves 134 located corresponding to the air outlet 11*a* and the air inlets 11*b*, respectively. The air-outlet valve 132 has an air-outlet diaphragm 132*a* mounted therein to allow air to pass through the air-outlet valve 132 in only one direction. Each of the air-inlet valves 134 is provided with an air-inlet diaphragm 134*a*, which allows air to pass through the air-inlet valve 134 in only one direction, and a plurality of bosses 134*b* for connecting the additionally mounted filters 5 to the air-inlet valves 134.

Figure 6A:
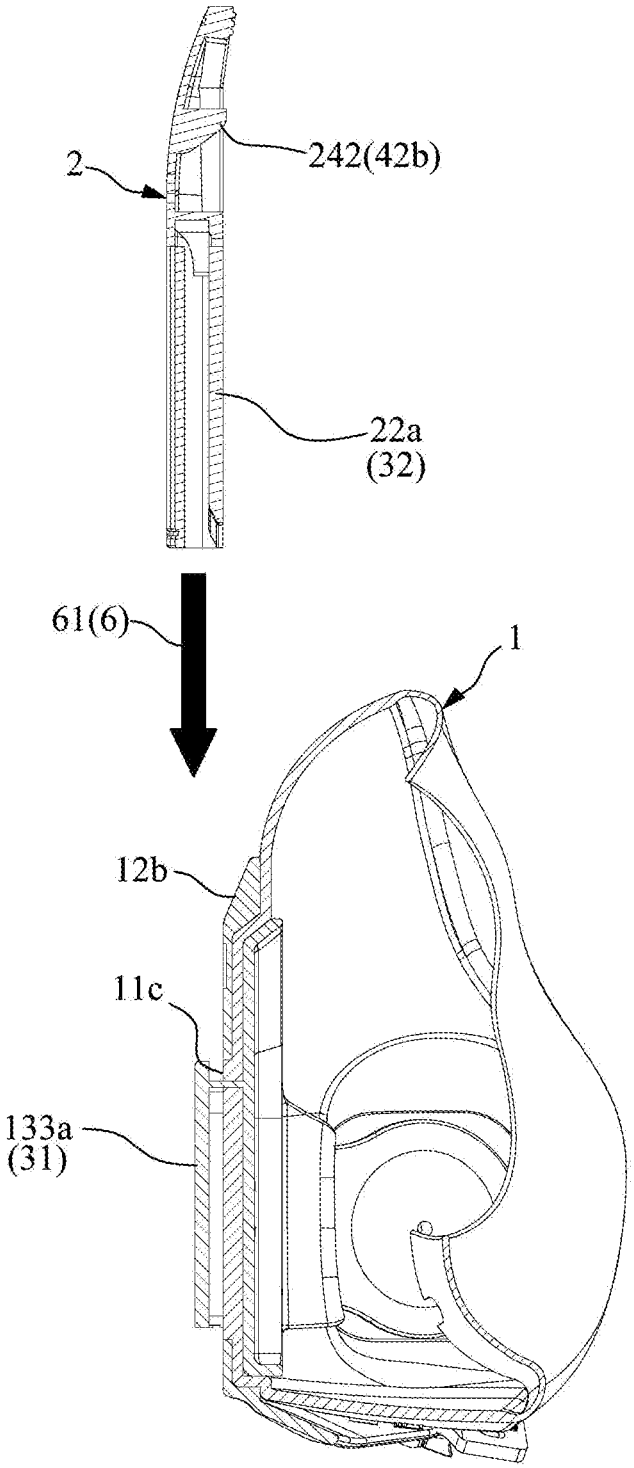
FIGS. 6A and 6B are side cutaway views showing the manner of assembling the front cover of FIG. 4 to the main body of FIG. 3.

Please refer to FIGS. 2, 3, 4, 6A and 7. The guide structure 3 includes a slide rail 31 formed on the supporting member 13 of the main body 1 for connecting with the front cover 2, a slide channel 32 formed on the front cover 2. More specifically, the slide rail 31 includes a U-shaped stop wall 133 is formed on one side of the air-outlet valve 132 distant from the support frame 131 and forwardly projected beyond the locating member 12 when the respiratory protection mask is fully assembled. The U-shaped stop wall 133 externally extends along and around the air-outlet valve 132 and has a downward opening, which faces toward the ground when the mask is worn on the wearer's face, and serves to change a direction in which air exhaled via the air-outlet valve 132 flows. The U-shaped stop wall 133 has different portions, including two parallelly spaced slide rail units 133*a* and a connecting arm 133*b*. The slide rail units 133*a* serves to guide the front cover 2 to move along a linear path 6, which is parallel to a longitudinal section 11*c* of the air outlet 11*a*, as shown in FIG. 6A. The connecting arm 133*b* serves as a female push section 41*a* of the limiting structure 4 formed on the main body 1 for upward pressing against a male push section 41*b* formed on the front cover 2, such that the front cover 2 having been connected to the slide rail 31 is stopped from being separated from the main body 1 from an end of the slide rail 31 closer to the ground.

As shown in FIGS. 2 and 3, each of the slide rail units 133*a* is provided toward an opening direction 63 of the air outlet 11*a* and near the support frame 131 with a sideward protruded elongated rib 133*c* for further restricting the front cover 2 from moving relative to the main body 1 and accordingly, making the front cover 2 more securely coupled with the main body 1.

Figure 5A:
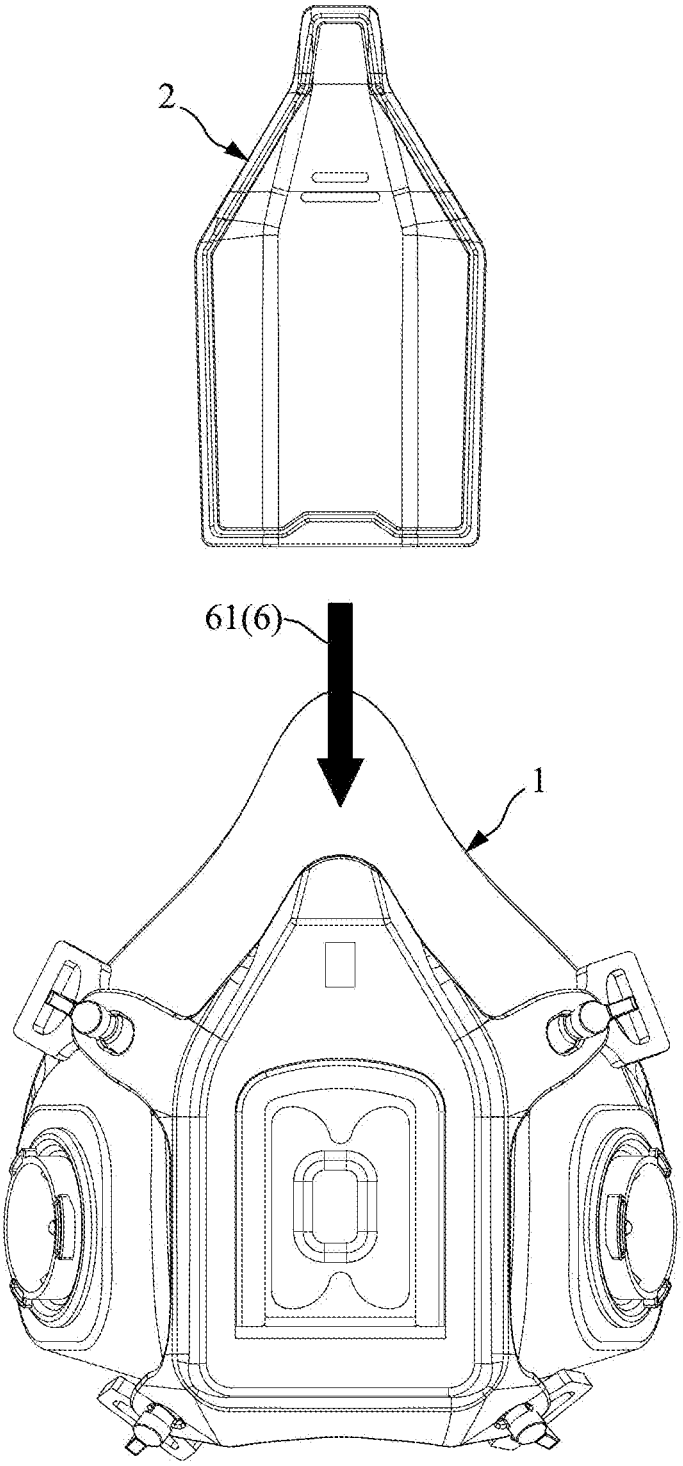
FIGS. 5A and 5B are front perspective views showing the manner of assembling the front cover of FIG. 4 to the main body of FIG. 3.
Figure 5B:
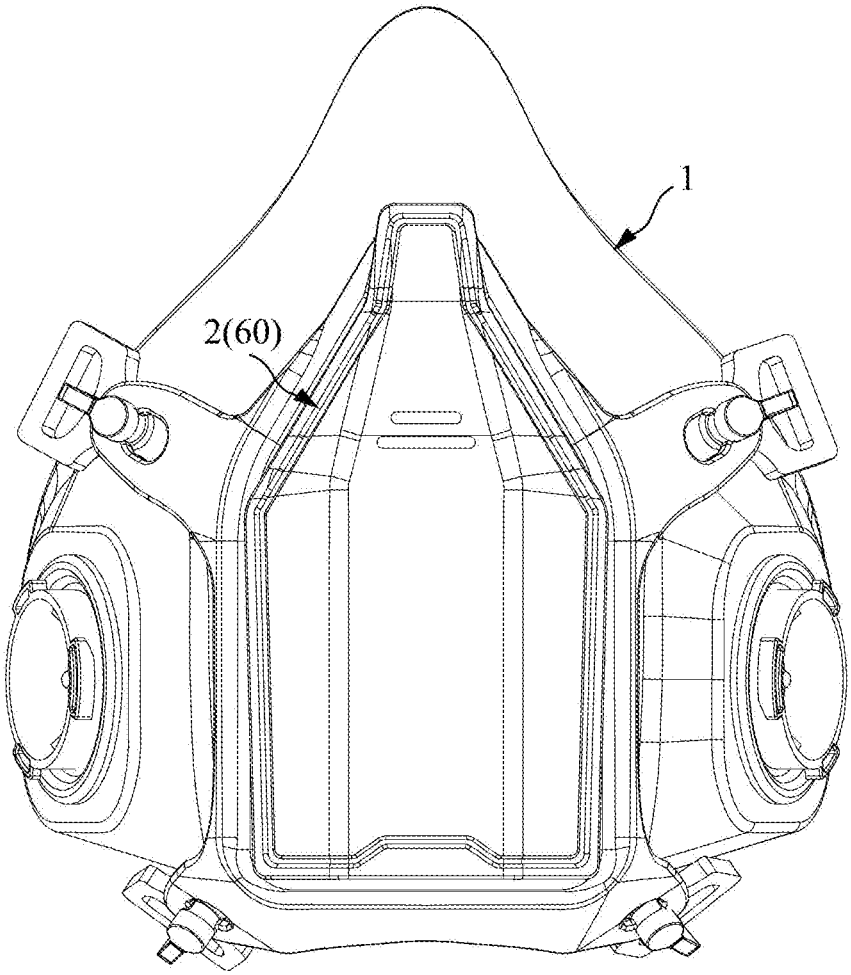
Figure 7:
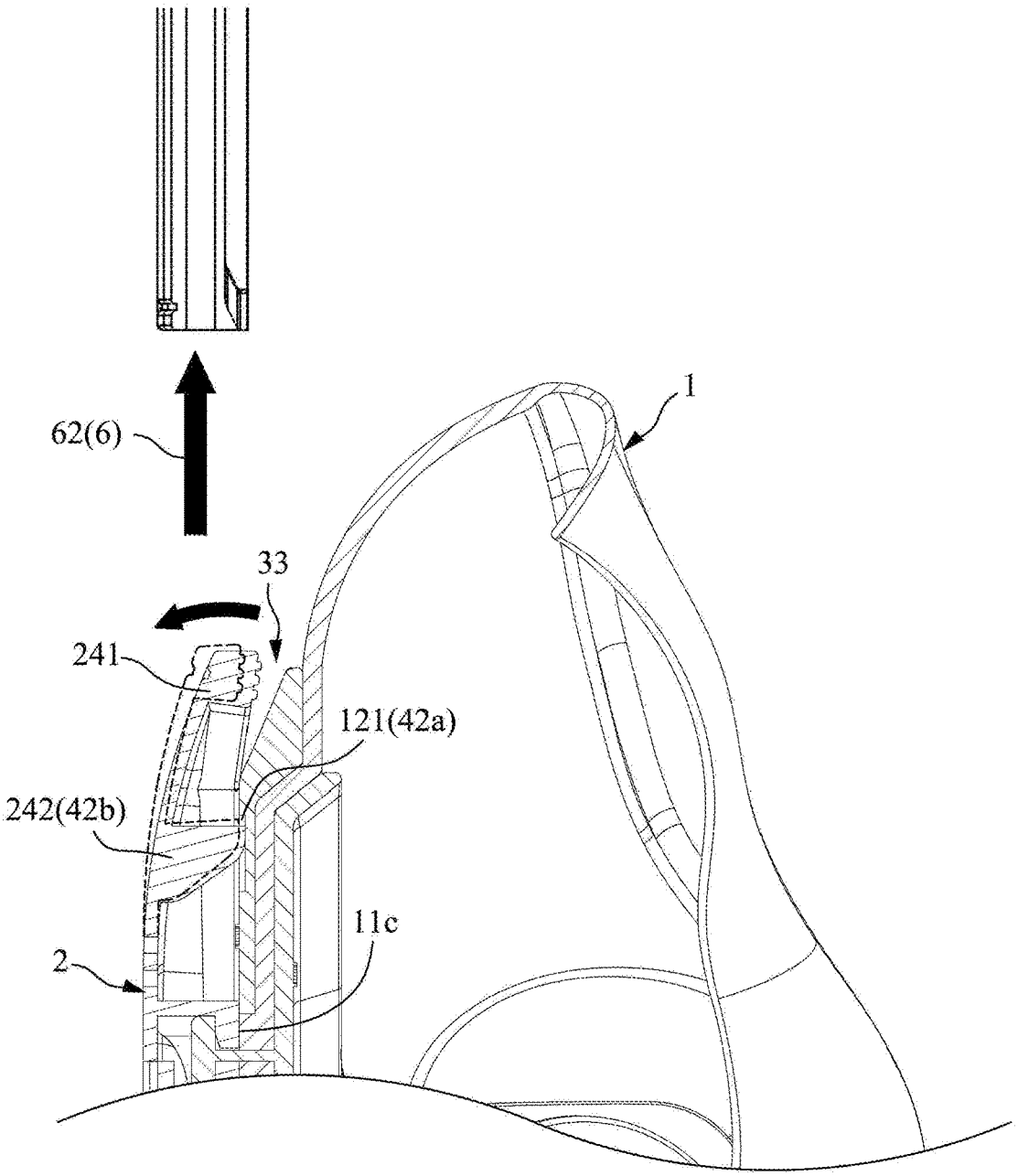
FIG. 7 is another side cutaway view showing the manner of removing the front cover from the main body by separating a protrusion on the front cover from a corresponding recess on the main body.

In FIG. 3, it can be seen the locating member 12 includes a substantially vertical flat portion 12*a* and a beveled portion 12*b*. The flat portion 12*a* is formed with a recess 121, which is located above the air-outlet valve 132, i.e. located near an end of the air-outlet valve 132 distant from the ground when the locating member 12 is assembled to the shielding member 11, and serves as a female fastener 42*a* in the limiting structure 4. After the front cover 2 is moved in an assembling direction 61 onto the slide rail 31, as shown in FIG. 5A, the female fastener 42*a* cooperates with the female push section 41*a* to hold the front cover 2 to an assembled position 60 on the main body 1, as shown in FIG. 5B. While the female push section 41*a* serves to stop the front cover 2 from moving further in the assembling direction 61 of the linear path 6 (see FIG. 5A) to separate from the slide rail 31, the female fastener 42*a* serves to stop the front cover 2 from moving in a detaching direction 62 opposite to the assembling direction 61 and separating from the slide rail 31 directly, as shown in FIG. 7.

Figure 4:
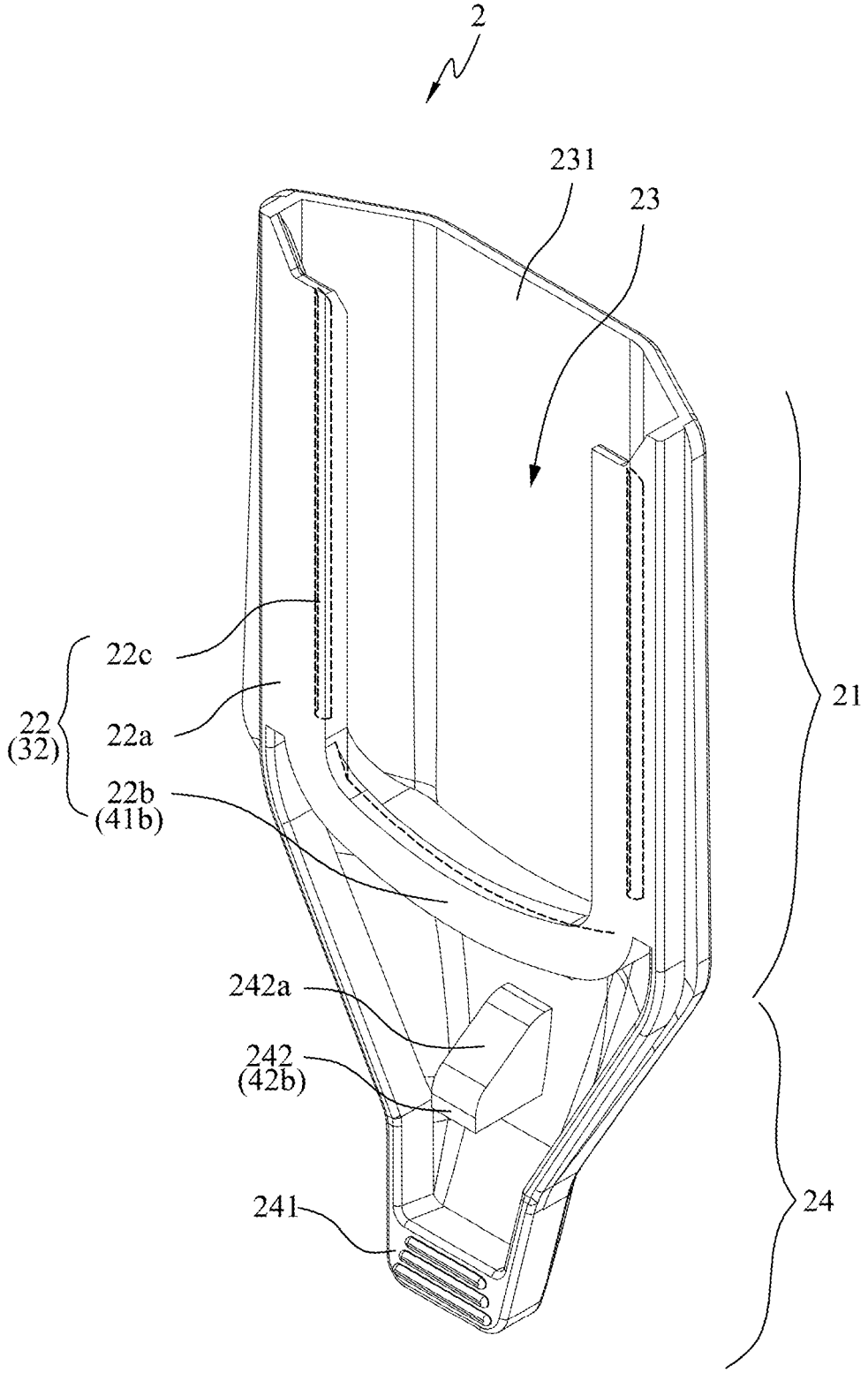
FIG. 4 is an upside down rear perspective view of a front cover of the respiratory protection mask of FIG. 1.

Please now refer to FIGS. 1, 2 and 4. The front cover 2 includes a covering portion 21, which is used to cover the air-outlet valve 132 when the front cover 2 is assembled to the main body 1, and an extension portion 24, which is extended from an end of the covering portion 21. One side of the covering portion 21 facing toward the main body 1 is formed with a U-shaped slide channel 22 corresponding to the U-shaped stop wall 133. The U-shaped slide channel 22 defines a semi-closed exhalation space 23, and has an opening 231 oriented opposite to the extension portion 24 and corresponding to the downward opening of the U-shaped stop wall 133. Two parallelly spaced lateral sides of the U-shaped slide channel 22 form two guide edges 22*a*, which are shaped corresponding to the two slide rail units 133*a* on the supporting member 13 of the main body 1; and a wall surface between the two guide edges 22*a* is hereinafter referred to as a slide channel wall section 22*b*, which serves as the male push section 41*b* in the limiting structure to press against the female push section 41*a*, i.e. the connecting arm 133*b* of the U-shaped stop wall 133. Further, each of the guide edges 22*a* is provided with a groove 22*c* corresponding to the rib 133*c* on each of the slide rail units 133*a* of the U-shaped stop wall 133.

Figure 6B:
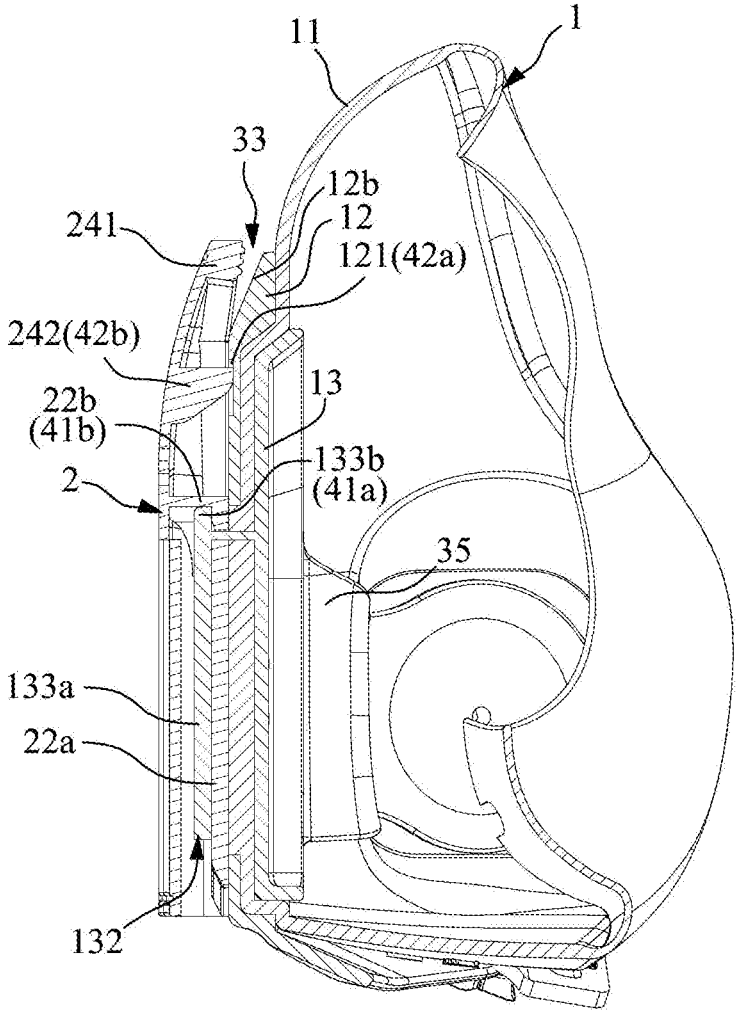

The extension portion 24 includes a grip section 241 located at an end of the extension portion 24 distant from the covering portion 21. The wearer can conveniently hold the grip section 241 with fingers to separate the front cover 2 from the main body 1 of the mask. The extension portion 24 further includes a protrusion 242 located between the grip section 241 and the covering portion 21 to serve as a male fastener 42*b* in the limiting structure 4 and is shaped corresponding to the female fastener 42*a*, i.e. the recess 121 on the locating member 12 of the main body 1. In the illustrated preferred embodiment, as can be seen in FIG. 6B, the protrusion 242 has a projected height slightly larger than an overall thickness of the front cover 2, such that the protrusion 242 is slightly projected beyond one side of the front cover 2 facing to the main body 1. Further, the protrusion 242 has, a beveled surface 242*a* located at one side thereof corresponding to the assembling direction 61 to facilitate sliding of the front cover 2 on and relative to the main body 1.

Please refer to FIGS. 5A, 5B, 6A and 6B. To couple the front cover 2 with the main body 1, simply move the front cover 2 in the assembling direction 61 of the linear path 6. In this way, the front cover 2 can be changed from a state of separating from the main body 1 into another state of fixing to the main body 1. More specifically, in the separating state, the slide channel 32, i.e. the U-shaped slide channel 22 on the front cover 2, is engaged with the slide rail 31, i.e. the U-shaped stop wall 133 on the main body 1, to thereby limit the front cover 2 from moving relative to the main body 1 in four directions (upward, downward, leftward and rightward relative to the ground). In this manner, the male push section 41*b* (i.e. the slide channel wall section 22*b* on the front cover 2) can always press against the female push section 41*a* (i.e. the connecting arm 133*b* of the U-shaped stop wall 133 on the main body 1) to stop the front cover 2 from separating from the main body 1 in the assembling direction 61. Further, the male fastener 42*b* (i.e. the protrusion 242 on the front cover 2) and the female fastener 42*a* (i.e. the recess 121 on the main body 1) are also engaged with each other to prevent the front cover 2 from directly separating from the main body 1 in the detaching direction 62, holding the front cover 2 to the main body 1 at the assembled position 60.

The protrusion 242 on the extension portion 24 has a projected height slightly larger the overall thickness of the front cover 2, as can be seen in FIGS. 6A and 6B. Therefore, when assembling, the front cover 2 to the main body 1, the protrusion 242 would be in contact with the beveled portion 12*b*, the flat portion 12*a* and the female fastener 42*a* sequentially, and would push against the flat portion 12*a* to cause deformation of the front cover 2. And, when the protrusion 242 is in contact with the recess 121, it would enter into the recess 121 and accordingly, allows the front cover 2 to restore from the deformed state. Wherein, the beveled portion 12*b* is located corresponding to the grip section 241 on the front cover 2 having been mounted at the assembled position 60. The slant shape of the beveled portion 12*b* enables the forming of a space 33 between the front cover 2 and the main body 1. The space 33 allows the wearer's fingers to extend thereinto to grip the front cover 2 in a convenient manner.

From the exploded view of FIG. 2 and from the side cutaway view of FIG. 6B, it can be found that the shielding member 11 and the locating member 12 are sandwiched between the front cover 2 and the supporting member 13 when the main body 1 and the front cover 2 are coupled with each other. It is because the supporting member 13 includes a flared section 35 that connects the air-inlet valves 134 to the air-outlet valve 132, such that the supporting member 13 has an overall volume larger than the air outlet 11*a* on the shielding member 11. Further, the sideward protruded elongated ribs 133*c* and the grooves 22*c* together enable the front cover 2 and the supporting member 13 to produce an enhanced sandwiching force to sandwich the shielding member 11 between them. In addition, according to an embodiment of the present invention, the shielding member 11 can be differently shaped, such that the sandwiched shielding member 11 is deformed under a sandwiching force to thereby continuously apply pressure to the front cover 2. In this way, the slide channel 32 formed by the guide edges 22*a* on the front cover 2 and the slide rail 31 formed by the slide rail units 133*a* on the main body 1 can be more securely engaged with each other.

Please refer to FIG. 7. In the illustrated embodiment, the front cover 2 has a certain degree of flexibility. To separate the front cover 2 from the main body 1, the wearer can simply grip the grip section 241 and pull it outward, i.e. in a direction away from the main body 1. At this point, the front cover 2 is flexibly deformed and the protrusion 242 is separated from the recess 121, and then, the wearer can simply move the front cover 2 in the detaching direction 62 to fully detach the front cover 2 from the main body 1.

In the preferred embodiment of the present invention, there is not any particular restriction to the positions for forming the slide rail 31 and the slide channel 32. In other embodiments, the main body 1 and the front cover 2 can be changed in design, such that the slide rail 31 is formed on the front cover 2 while the slide channel 32 is formed on the main body 1. In addition, there is not any special restriction to the detailed positions for forming different parts of the guide structure 3, such as the slide rail 31. It is possible to form the guide structure 3 on the locating member 12 or on the shielding member 11. Also, there is not any particular restriction to the configuration or the positions of the limiting structure 4. Depending on actual need in use, it is possible to change the protrusion or the recess to other similar fastener elements, and this is also applicable to other elements on different positions of the main body 1. Further, it is not necessary for the main body 1 to always include the locating member 12 or the supporting member 13. The number and the type of different elements for forming the main body 1 can also be freely changed according to actual need in use.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A respiratory protection mask, comprising:

a main body including a shielding member for shielding a wearer's mouth and nose; the shielding member being formed with an air outlet and at least one air inlet; an air-outlet valve being mounted on the air outlet, and an air-inlet valve being mounted on the at least one air inlet; and a front cover being detachably assembled to the main body;

the mask being characterized in: a guide structure and a limiting structure are provided between the main body and the front cover;

the guide structure including a slide rail formed on the main body and a slide channel formed on the front cover; the slide channel being guided by the slide rail for bringing the front cover to move along a linear path that is parallel to a longitudinal section of the air outlet, such that the front cover is assembled to the main body in an assembling direction of the linear path and covers the air-outlet valve; and the limiting structure including a male fastener formed on the front cover and a female fastener formed on the main body; the male fastener being able to engage with the female fastener when the front cover is located at an assembled position on the linear path, such that the front cover is stopped moving away from the assembled position in a detaching direction opposite to the assembling direction without detaching from the main body.

2. The respiratory protection mask as claimed in claim 1, wherein the front cover includes a covering portion used to cover the air outlet when the front cover is located at the assembled position; and an opening is formed by the covering portion and the main body collectively for changing the direction of an airflow passing through the air outlet, such that the airflow leaves the respiratory protection mask via the opening that downwardly faces toward the ground.

3. The respiratory protection mask as claimed in claim 2, wherein the front cover further includes an extension portion extended from an end of the covering portion facing in the detaching direction; the male fastener being formed on the extension portion and being detachable from the female fastener when any one of the main body and the extension portion is flexibly deformed.

4. The respiratory protection mask as claimed in claim 3, wherein the main body includes a flat portion and a beveled portion located corresponding to the covering portion and the extension portion of the front cover, respectively, such that a space is formed between the beveled portion and the extension portion.

5. The respiratory protection mask as claimed in claim 4, wherein the female fastener is formed on the flat portion; and the male fastener, when moving in, the assembling direction, is in contact with the beveled portion, the flat portion and the female fastener sequentially; such that the male fastener and the flat portion push against each other to cause deformation of one of the front cover and the main body.

6. The respiratory protection mask as claimed in claim 1, wherein the limiting structure further includes a male push section formed on the front cover and a female push section formed on the main body; and the male and the female push section being used to stop the front cover from moving further in the assembling direction after the front cover has been moved to the assembled position.

7. The respiratory protection mask as claimed in claim 6, wherein the slide rail includes two parallelly spaced slide rail units; and the female push section and the slide rail units together forming a U-shaped stop wall that externally surrounds the air-outlet valve.

8. The respiratory protection mask as claimed in claim 1, wherein the main body further includes a supporting member detachably connectable to the shielding member; the air-outlet valve, the at least one air-inlet valve and the slide rail being formed on the supporting member; and the shielding member being sandwiched between the supporting member and the front cover after the front cover has been assembled to the main body.

9. The respiratory protection mask as claimed in claim 8, wherein the slide rail is provided toward an opening direction and near two lateral sides of the air outlet with two elongated ribs, and the slide channel is provided at locations corresponding to the elongated ribs with two grooves; and the engagement, of the elongated ribs with the grooves further enabling the front cover and the supporting member to produce an increased sandwiching force to sandwich the shielding member between them.

* * * * *